US010378072B2

(12) United States Patent
Hinoshita et al.

(10) Patent No.: US 10,378,072 B2
(45) Date of Patent: Aug. 13, 2019

(54) MARAGING STEEL

(71) Applicant: DAIDO STEEL CO., LTD., Nagoya-shi (JP)

(72) Inventors: Keita Hinoshita, Nagoya (JP); Kenji Sugiyama, Nagoya (JP); Hiroyuki Takabayashi, Nagoya (JP); Shigeki Ueta, Nagoya (JP)

(73) Assignee: DAIDO STEEL CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 15/154,737

(22) Filed: May 13, 2016

(65) Prior Publication Data

US 2016/0340753 A1 Nov. 24, 2016

(30) Foreign Application Priority Data

May 22, 2015 (JP) ..... 2015-104465
Dec. 18, 2015 (JP) ..... 2015-247124

(51) Int. Cl.
*C21D 6/02* (2006.01)
*C21D 6/00* (2006.01)
(Continued)

(52) U.S. Cl.
CPC ..... *C21D 6/02* (2013.01); *C21D 1/25* (2013.01); *C21D 6/004* (2013.01); *C21D 6/007* (2013.01);
(Continued)

(58) Field of Classification Search
CPC .... C21D 1/25; C21D 2211/008; C21D 6/007; C21D 6/02; C21D 6/04; C22C 38/002;
(Continued)

(56) References Cited

U.S. PATENT DOCUMENTS 3,262,777 A * 7/1966 Sadowski ..... C22C 38/44 148/621
3,294,527 A * 12/1966 Floreen ..... C22C 38/08 148/328
(Continued)

FOREIGN PATENT DOCUMENTS

CN 100580124 C 1/2010
CN 103484787 A 1/2014
(Continued)

OTHER PUBLICATIONS

Extended European Search Report dated Oct. 18, 2016.
(Continued)

*Primary Examiner* — Matthew E. Hoban
*Assistant Examiner* — Anthony M Liang
(74) *Attorney, Agent, or Firm* — McGinn I.P. Law Group, PLLC.

(57) ABSTRACT

The present invention relates to a maraging steel containing, in terms of mass %, 0.10≤C≤0.35, 9.0≤Co≤20.0, 1.0≤(Mo+W/2)≤2.0, 1.0≤Cr≤4.0, a certain amount of Ni, a certain amount of Al, and V+Nb≤0.60, with the balance being Fe and inevitable impurities, in which in a case of V+Nb≤0.020, the amount of Ni is 6.0≤Ni≤9.4 and the amount of Al is 1.4≤Al≤2.0, and in a case of 0.020<V+Nb≤0.60, the amount of Ni is 6.0≤Ni≤20.0 and the amount of Al is 0.50≤Al≤2.0.

20 Claims, 3 Drawing Sheets

(51) Int. Cl.

| | |
|---|---|
| ***C21D 6/04*** | (2006.01) |
| ***C21D 7/13*** | (2006.01) |
| ***C21D 1/25*** | (2006.01) |
| ***C22C 38/06*** | (2006.01) |
| ***C22C 38/44*** | (2006.01) |
| ***C22C 38/50*** | (2006.01) |
| ***C22C 38/52*** | (2006.01) |
| ***C22C 38/00*** | (2006.01) |
| ***C22C 38/02*** | (2006.01) |
| ***C22C 38/46*** | (2006.01) |
| ***C22C 38/48*** | (2006.01) |
| ***C22C 38/54*** | (2006.01) |

(52) U.S. Cl.
CPC ..... *C21D 6/04* (2013.01); *C21D 7/13* (2013.01); *C22C 38/001* (2013.01); *C22C 38/002* (2013.01); *C22C 38/02* (2013.01); *C22C 38/06* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/008* (2013.01)

(58) Field of Classification Search
CPC ..... C22C 38/02; C22C 38/06; C22C 38/10; C22C 38/105; C22C 38/44; C22C 38/46; C22C 38/48; C22C 38/50; C22C 38/52; C22C 38/54
See application file for complete search history.

(56) References Cited

U.S. PATENT DOCUMENTS

| | | | | |
|---|---|---|---|---|
| 5,393,488 | A | 2/1995 | Rhoads et al. | |
| 5,866,066 | A | 2/1999 | Hemphill et al. | |
| 8,152,938 | B2 | 4/2012 | Montagnon et al. | |
| 8,153,056 | B2 | 4/2012 | Montagnon et al. | |
| 8,192,560 | B2 | 6/2012 | Montagnon et al. | |
| 9,506,125 | B2 * | 11/2016 | Ueta | C21D 6/004 |
| 2008/0193321 | A1 | 8/2008 | Montagnon et al. | |
| 2011/0041961 | A1 | 2/2011 | Montagnon et al. | |
| 2011/0048583 | A1 | 3/2011 | Montagnon et al. | |
| 2013/0327446 | A1 | 12/2013 | Ueta et al. | |

FOREIGN PATENT DOCUMENTS

| | | | | |
|---|---|---|---|---|
| EP | 2 671 955 | A1 | | 12/2013 |
| GB | 1243382 | A | | 8/1971 |
| JP | S 53-30916 | A | | 3/1978 |
| JP | 2002-161342 | A | | 6/2002 |
| JP | 2002161342 | A | * | 6/2002 |
| JP | 2002-285290 | A | | 10/2002 |
| JP | 2011-195922 | A | | 10/2011 |
| JP | 2014-012887 | A | | 1/2014 |

OTHER PUBLICATIONS

Chinese Office Action, dated Jan. 3, 2018, in Chinese Application No. 201610345295.5 and English Translation thereof.
Chinese Office Action, dated Jan. 3, 2018, in Chinese Application No. 201610345305.5 and English Translation thereof.
United States Office Action dated Sep. 13, 2017 in co-pending U.S. Appl. No. 15/154,729.
United States Office Action dated Apr. 20, 2018 in U.S. Appl. No. 15/154,729.
United States Advisory Action dated Jul. 20, 2018 in U.S. Appl. No. 15/154,729.
European Office Action, dated Sep. 25, 2018, in European Patent Application No. 16170618.9.
European Office Action, dated Feb. 15, 2019, in European Application No. 16 170 618.9.
Chinese Office Action, dated Oct. 31, 2018, in Chinese Application No. 2016103452955 and English Translation thereof.
Chinese Office Action, dated May 8, 2019, in Chinese Application No. 201610345295.5 and English Translation thereof.

* cited by examiner

MARAGING STEEL

FIELD OF THE INVENTION

The present invention relates to a maraging steel, and more specifically, it relates to a maraging steel has high strength and excellent toughness and ductility, and is usable for engine shafts and the like.

BACKGROUND OF THE INVENTION

Maraging steels are carbon-free or low-carbon steels, and are obtained by subjecting steels containing Ni, Co, Mo, Ti and like elements in high proportions to solution heat treatment and then to quenching and aging treatment.

Maraging steels have characteristics including (1) good machinability attributable to formation of soft martensite in a quenched stage, (2) very high strength attributable to precipitation of intermetallic compounds, such as $Ni_3Mo$, $Fe_2Mo$ and $Ni_3Ti$, in martensite texture through aging treatment, and (3) high toughness and ductility in spite of its high strength.

Maraging steels have therefore been used as structural materials (e.g. engine shafts) for spacecraft and aircraft, structural materials for automobiles, materials for high-pressure vessels, materials for tools, and so on.

So far, 18Ni Maraging steels (e.g. Fe-18Ni-9Co-5Mo-0.5Ti-0.1Al) of Grade 250 ksi (1724 MP) have been used for engine shafts of aircraft. However, with the recent demand of improving air pollution by, for example, tightening control on exhaust gas emission, enhancement of efficiency has been required of aircraft also. From the viewpoint of designing engines, there have been increasing demands for high-strength materials capable of enduring high power, downsizing and weight reduction.

As to such high-strength materials, various types of steels have been put forth until now.

For example, Patent Document 1 has disclosed a ultrahigh tensile strength tough-and-hard steel containing 0.05 to 0.20 weight % of C, at most 2.0 weight % of Si, at most 3.0 weight % of Mn, 4.1 to 9.5 weight % of Ni, 2.1 to 8.0 weight % of Cr, 0.1 to 4.5 weight % of Mo which may be substituted partially or entirely with a doubling amount of W, 0.2 to 2.0 weight % of Al, and 0.3 to 3.0 weight % of Cu, with the balance being Fe and inevitable impurities.

In the document cited above, there is a description that strength of 150 kg/mm$^2$ (1471 MPa) or higher can by achieved by multiple addition of Cu and Al to low-carbon Ni—Cr—Mo steel without significantly impairing toughness and weldability.

In addition, Patent Document 2 has disclosed a high-strength highly-fatigue-resistant steel containing about 10 to 18 weight % of Ni, about 8 to 16 weight % of Co, about 1 to 5 weight % of Mo, 0.5 to 1.3 weight % of Al, about 1 to 3 weight % of Cr, at most about 0.3 weight % of C, and less than about 0.10 weight % of Ti, with the balance being Fe and inevitable impurities, and further containing both of fine intermetallic compounds and carbides made to precipitate out.

In Table 2 of the document cited above are presented findings that such a steel has a tensile strength of 284 to 327 ksi (1959 to 2255 MPa) and an elongation of 7 to 15%.

Although maraging steels are generally high-strength materials which excel in toughness and ductility, it is known that, in a tensile strength range exceeding 2,000 MPa, it is difficult to ensure fatigue resistance as well as toughness and ductility. Thus, as for general-purpose materials, only Grade-250 ksi 18Ni maraging steels has been utilized so far.

On the other hand, steels of the type which are disclosed in Patent Document 2 are also known as high-grade materials for general-purpose use. However, in order to meet the demands, for example, for increasing the efficiency of aircraft, further increase in strength (2,300 MPa or higher) without attended by reduction in fatigue resistance as well as toughness and ductility has been required of maraging steels.

Against this backdrop, the present applicant has proposed Patent Document 3 as a maraging steel having a tensile strength of 2,300 MPa or higher, an elongation of 7% or larger and excellent fatigue characteristics. However, such a maraging steel is apt to form thin tabular AlN particles which are supposed to be inclusions affecting low-cycle fatigue characteristics. Accordingly, the maraging steel may suffer deterioration in low-cycle fatigue characteristics, and high-level stabilization of low-cycle fatigue characteristics may be difficult for it to achieve.

Patent Document 1: JP-A-S53-30916
Patent Document 2: U.S. Pat. No. 5,393,488
Patent Document 3: JP-A-2014-12887

SUMMARY OF THE INVENTION

A problem that the present invention is to solve consists in providing maraging steels each of which has a tensile strength of 2,300 MPa or higher and excels in toughness, ductility and fatigue characteristics.

The gist of a maraging steel according to the present invention which aims to solve the above problem consists in consisting of:

as essential components,
0.10 mass %≤C≤0.35 mass %,
9.0 mass %≤Co≤20.0 mass %,
1.0 mass %≤(Mo+W/2)≤2.0 mass %,
1.0 mass %≤Cr≤4.0 mass %,
a certain amount of Ni, and
a certain amount of Al, and
as optional components,
Ti≤0.10 mass %,
S≤0.0010 mass %,
N≤0.0020 mass %,
V+Nb≤0.60 mass %,
B≤0.0050 mass %, and
Si≤1.0 mass %,
with the balance being Fe and inevitable impurities, in which in a first case where the contents of V and Nb satisfy V+Nb≤0.020 mass %, the amount of Ni and the amount of Al are:

6.0 mass %≤Ni≤9.4 mass %, and
1.4 mass %≤Al≤2.0 mass %, and in which in a second case where the contents of V and Nb satisfy 0.020 mass %<V+Nb≤0.60 mass %, the amount of Ni and the amount of Al are:

6.0 mass %≤Ni≤20.0 mass %, and
0.50 mass %≤Al≤2.0 mass %.

The maraging steel preferably has a tensile strength of at least 2,300 MPa at room temperature (23° C.), and preferably has an elongation of at least 8% at room temperature (23° C.).

It is preferable that the maraging steel of the first case satisfies the following relational expression (1):

$$\text{Parameter } X \geq 45 \quad (1)$$

where $X=5.5[C]+11.6[Si]-1.4[Ni]-5[Cr]-1.2[Mo]+0.7[Co]+41.9[Al]-7[V]-98.4[Nb]+3.3[B]$, and each element symbol with braces represents the content (by mass %) of each element.

On the other hand, it is preferable that the maraging steel of the second case satisfies the following relational expression (2):

$$\text{Parameter } X \geq 10 \quad (2)$$

where $X=5.5[C]+11.6[Si]-1.4[Ni]-5[Cr]-1.2[Mo]+0.7[Co]+41.9[Al]-7[V]-98.4[Nb]+3.3[B]$, and each element symbol with braces represents the content (by mass %) of each element.

With the percentage of each primary element content being confined to the range specified above, and preferably, at the same time, with the individual content range of each element being optimized so as to satisfy the relational expression (1) or (2), it is possible to control the form (precipitate geometry) of AlN which is supposed to be inclusion affecting low-cycle fatigue characteristics. Thus it becomes possible to obtain maraging steels which each have not only a tensile strength of at least 2,300 MPa and an elongation of at least 8% but also fatigue characteristics stabilized at a high level.

DETAILED DESCRIPTION OF THE INVENTION

Figure 1:
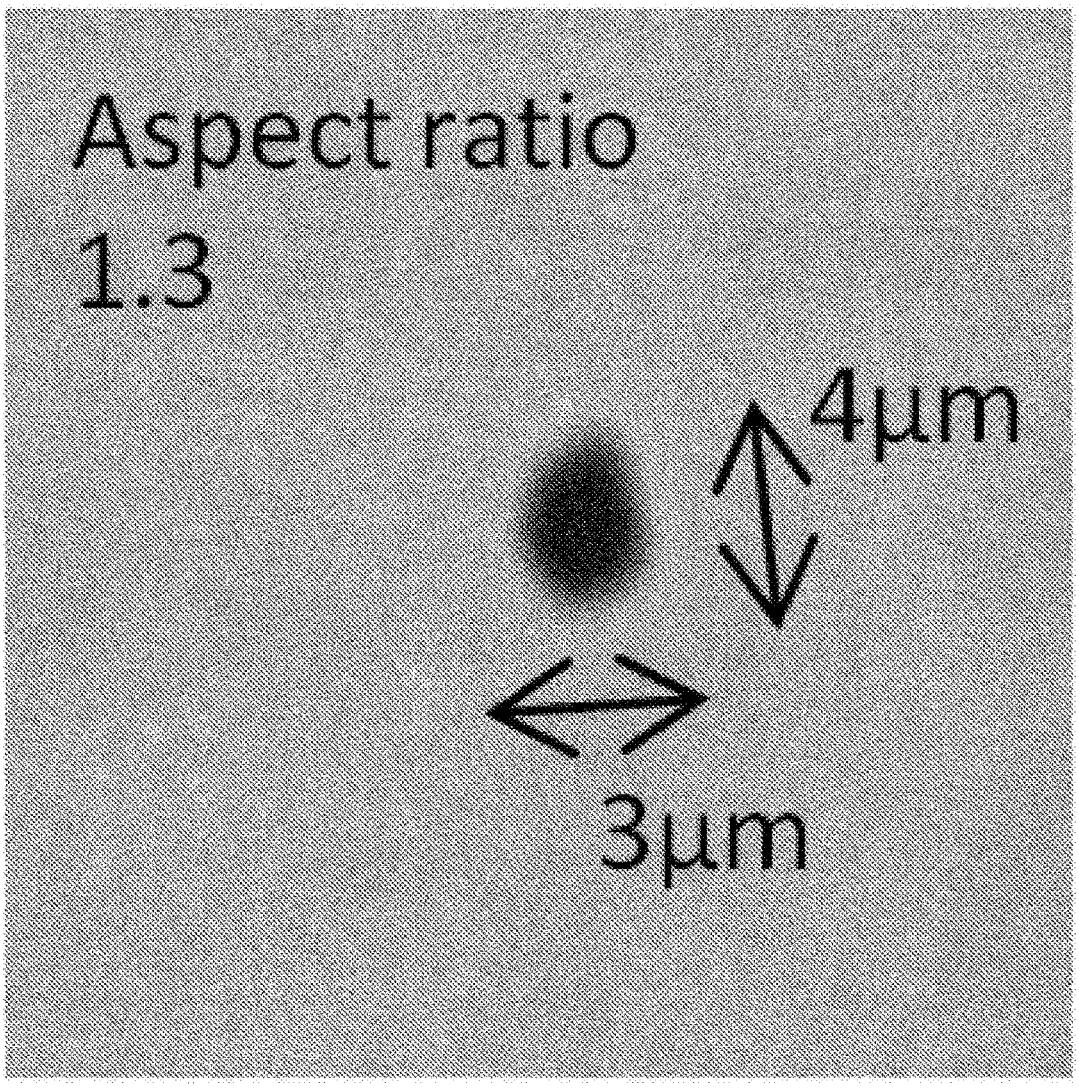
FIG. 1 is an SEM photograph of a massive AlN particle.

Embodiments of the present invention are described below in detail.

[1. Maraging Steel]

[1.1. Primary Constituent Elements]

Each of the maraging steels according to embodiments of the present invention contains elements in their respective content ranges as mentioned below, with the balance being Fe and inevitable impurities. Kinds and content ranges of added elements and reasons for limitations thereon are as follows.

(1) 0.10 mass %≤C≤0.35 mass %

C contributes to enhancement of matrix strength through precipitation of a Mo-containing carbide such as $Mo_2C$. In addition, a moderate amount of carbide remaining in the matrix can inhibit prior austenite grain size from becoming excessively large during the solution heat treatment. The smaller the prior austenite grain size is, the finer the martensite produced, and thereby the higher toughness and ductility as well as the higher strength can be achieved. In order to ensure such effects, the C content is required to be at least 0.10 mass %. The C content is adjusted preferably to 0.16 mass % or more, and far preferably to 0.20 mass % or more.

On the other hand, in the case where the C content becomes excessive, the Mo-containing carbide precipitates out in large amounts to result in shortage of Mo to be used for precipitation of intermetallic compounds. Further, in order to convert the carbides into solid solution, it becomes necessary to perform solution heat treatment at higher temperatures, and thereby the prior austenite grain size becomes excessively large. As a result, the optimum temperature range for inhibiting the prior austenite grain size from becoming excessively large and converting carbides into solid solution becomes narrow. On this account, elongation is reduced by influences of excessive increase in prior austenite grain size or carbides not-yet-converted into solid solution. Accordingly, the C content is required to be at most 0.35 mass %. The C content is adjusted preferably to 0.30 mass % or less, and far preferably to 0.25 mass % or less.

(2.1) 6.0 mass %≤Ni≤9.4 mass % (the Maraging Steel of the First Case where V+Nb≤0.020 mass %)

Ni contributes to enhancement of matrix strength through precipitation of intermetallic compounds such as $Ni_3Mo$ and NiAl. In the case where the total for V and Nb contents is 0.020 mass % or less, the Ni content is required to be at least 6.0 mass % for the purpose of producing such an effect. The Ni content is adjusted preferably to 7.0 mass % or more.

On the other hand, in the case where the Ni content becomes excessive, lowering of Ms point occurs, and the amount of residual austenite is increased and satisfactory martensitic structure cannot be formed to result in lowering of strength. Accordingly, the Ni content is required to be at most 9.4 mass %. The Ni content is adjusted preferably to 9.0 mass % or less.

(2.2) 6.0 mass %≤Ni≤20.0 mass % (the Maraging Steel of the Second Case where 0.020 mass %≤V+Nb≤0.60 mass %)

In the other case where the total for V and Nb contents is more than 0.020 mass %, the Ni content is required to be at least 6.0 mass % for the purpose of producing the effect mentioned above. The Ni content is adjusted preferably to 7.0 mass % or more, and far preferably to 10.0 mass % or more.

In the case where the total for V and Nb contents is more than 0.020 mass %, strength enhancement becomes possible through the pinning effect of V carbide or Nb carbide. Therefore the Ni content can be adjusted to 20.0 mass % or less. In order to easily attain excellent strength (e.g. a tensile strength of 2,310 MPa or higher), the Ni content is preferably adjusted to 19.0 mass % or less. In addition, in order to easily attain excellent fracture toughness (e.g. $K_{1C}$ of 32 MPa√m or higher), the Ni content is preferably adjusted to 12.0 mass % or more.

(3) 9.0 mass %≤Co≤20.0 mass %

Co has an effect of promoting precipitation of intermetallic compounds, such as $Ni_3Mo$ and NiAl, by being left in a state of solid solution in the matrix. In order to ensure such an effect, the Co content is required to be at least 9.0 mass %. The Co content is adjusted preferably to 11.0 mass % or more, far preferably to 12.0 mass % or more, and further preferably to 14.0 mass % or more.

On the other hand, in the case where the Co content becomes excessively high, precipitation of intermetallic compounds is promoted to an excessive degree, and thereby the precipitation amount of Mo-containing carbides is reduced. By the influence of such reduction, the elongation is lowered. Accordingly, the Co content is required to be at most 20.0 mass %. The Co content is adjusted preferably to 18.0 mass % or less, and far preferably to 16.0 mass % or less.

(4.1) 1.0 mass %≤(Mo+W/2)≤2.0 mass % (in the Case of Using Either Mo or W, or Both)

W forms a W-containing carbide such as $W_2C$ and contributes to enhancement of matrix strength as is the case with the Mo-containing carbide mentioned above. Accordingly, part or all of Mo can be replaced with W. However, the strength enhancement effect produced by addition of W is about ½, on a mass % basis, that produced by addition of Mo. Thus the total for Mo and W contents is required to be 1.0 mass % or more in terms of (Mo+W/2).

On the other hand, in the case where the Mo and W contents are excessively high, it becomes necessary to perform heat treatment at higher temperatures in order that carbides, such as $Mo_2C$ and $W_2C$, precipitating out under solidification can be dissolved, thereby resulting in excessive increase in prior austenite grain size. Consequently, the optimum temperature range for inhibiting coarsening of prior austenite grain size and dissolving the carbides becomes narrow. The decreasing of elongation is due to coarsening of prior austenite grain size and carbides which remain after solution treatment. Accordingly, the total for Mo and W contents is required to be at most 2.0 mass % in terms of (Mo+W/2). The total for Mo and W contents is adjusted preferably to 1.8 mass % or less, and far preferably to 1.6 mass % or less, in terms of (Mo+W/2).

Incidentally, in the case where both Mo and W are included, Mo≥0.40 mass % is appropriate for a reason that it allows the securing of an increment in matrix strength by precipitation of intermetallic compounds such as $Ni_3Mo$.

(4.2) 1.0 mass %≤Mo≤2.0 mass % (in the Case of Using Mo by Itself)

Mo contributes to enhancement of matrix strength through the precipitation of intermetallic compounds such as $Ni_3Mo$ and Mo-containing carbides such as $Mo_2C$. In the case of using Mo by itself, the Mo content is required to be at least 1.0 mass % in order to ensure such an effect.

On the other hand, in the case where the Mo content is excessively high, it becomes necessary to perform heat treatment at higher temperatures in order that carbides, such as $Mo_2C$, precipitating out under solidification can be converted into solid solution, thereby resulting in excessive increase in prior austenite grain size. Consequently, the optimum temperature range for converting the carbides into solid solution while inhibiting the prior austenite grain size from becoming excessively large becomes narrow. Thus the elongation is reduced through the influences of excessive increase in prior austenite grain size or carbides not-yet-converted into solid solution. Accordingly, the Mo content is required to be at most 2.0 mass %. The Mo content is adjusted preferably to 1.8 mass % or less, and far preferably to 1.6 mass % or less.

(4.3) 2.0 mass %≤W≤4.0 mass % (in the Case of Using W by Itself)

For the same reasons as in the case of Mo, the appropriate W content in the case of using W by itself is 2.0 mass % or more.

In addition, for the same reasons as in the case of Mo, the appropriate W content is 4.0 mass % or less, preferably 3.6 mass % or less, and far preferably 3.2 mass % or less.

(5) 1.0 mass %≤Cr≤4.0 mass %

Cr contributes to improvement in ductility. It is conceivable that the ductility improvement by addition of Cr may be attributed to solid solution of Cr into Mo-containing carbides, which makes the carbides spherical in shape. In order to ensure such an effect, the Cr content is required to be at least 1.0 mass %. The Cr content is adjusted preferably to 2.0 mass % or more.

On the other hand, in the case where the Cr content is excessively high, reduction in strength is caused. As a reason for this, it is conceivable that Mo-containing carbides become oversized by excessive addition of Cr. Accordingly, the Cr content is required to be at most 4.0 mass %. The Cr content is adjusted preferably to 3.5 mass % or less, and far preferably to 3.0 mass % or less. By adjusting the Cr content to such a range, not only high strength but also excellent fracture toughness characteristics (e.g. 32 MPa√m or higher) come to be achieved.

(6.1) 1.4 mass %≤Al≤2.0 mass % (the Maraging Steel of the First Case where V+Nb≤0.020 mass %)

Al contributes to enhancement of matrix strength through precipitation of intermetallic compounds such as NiAl. In addition, the higher the Al content is, the higher the probability that the shape of AlN precipitates changes from planar to spherical, and the more likely variations in low-cycle fatigue characteristics are to be controlled. In the case where the total for V and Nb contents is 0.020 mass % or less, the Al content is required to be at least 1.4 mass % in order to ensure such effects.

On the other hand, in the case where the Al content is excessively high, amounts of intermetallic compounds such as NiAl become excessive, and thereby toughness and ductility are lowered. Accordingly, the Al content is required to be at most 2.0 mass %. The Al content is adjusted preferably to 1.7 mass % or less.

(6.2) 0.50 mass %≤Al≤2.0 mass % (the Maraging Steel of the Second Case where 0.020 mass %<V+Nb≤0.6 mass %)

On the other hand, in the case where the total for V and Nb contents is higher than 0.020 mass %, there occurs a phenomenon that the grain boundary of prior austenite becomes fine owing to the pinning effect of V carbides or Nb carbides. Allowing the prior austenite to have fine grain boundary not only contributes to strength enhancement but also produces the effect of inhibiting AlN from having a planar shape (from growing in its length direction). Accordingly, in the case where the total for V and Nb contents is higher than 0.020 mass %, it becomes possible to adjust the Al content to 0.50 mass % or more. The Al content is adjusted preferably to 0.90 mass % or more.

On the other hand, in the case where the Al content is excessively high, amounts of intermetallic compounds such as NiAl becomes excessive, and thereby toughness and ductility are lowered. Accordingly, the Al content is required to be at most 2.0 mass %. The Al content is adjusted preferably to 1.7 mass % or less.

(7) Ti≤0.10 mass % (0 mass %≤Ti≤0.10 mass %)

Ti depresses cleanliness through the formation of TiC, TiN or the like, and thereby deterioration in low-cycle fatigue characteristics is caused. Accordingly, the Ti content is required to be at most 0.10 mass %. The Ti content may be zero (Ti=0 mass %).

(8) S≤0.0010 mass % (0 mass %≤S≤0.0010 mass %)

S is an impurity, and coarse grain sulfides are formed if the S content is high. Formation of sulfides not only leads to deterioration in fatigue characteristics but also brings about reduction in tensile strength. Accordingly, the S content is required to be at most 0.0010 mass %. The S content may be zero (S=0 mass %).

(9) N≤0.0020 mass % (0 mass %≤N≤0.0020 mass %)

N is an impurity, and coarse grain nitrides, such as AlN, are formed if the N content is high. Formation of such nitrides leads to deterioration fatigue characteristics. Accordingly, the N content is required to be at most 0.0020 mass %. The N content may be zero (N=0 mass %).

[1.2. Elements Producing Effects by Addition (Secondary Constituent Elements)]

In addition to the primary constituent elements mentioned above, each of the maraging steels according to embodiments of the present invention can further contain elements as mentioned below. Kinds and content ranges of added elements and reasons for limitations thereon are as follows.

(10) V and Nb: V+Nb≤0.60 mass % (0 mass %≤V+Nb≤0.60 mass %)

(10.1) 0.020 mass %<V+Nb≤0.6 mass % (the Maraging Steel of the Second Case where 0.020 mass %<V+Nb≤0.60 mass %)

In the present invention, even in the case where the total for V and Nb contents is 0.020 mass % or less, sufficient tensile strength and fatigue strength can be secured. However, by incorporation of specified amounts of V and/or Nb, M2C type carbides or MC type carbides are formed and they conduce to improvement in hydrogen embrittlement characteristics. In addition, incorporation of V and/or Nb ensures excellent fracture toughness characteristics. These effects can be effectively seen in the case where the total for V and Nb contents is higher than 0.020 mass %. The total for V and Nb contents is adjusted preferably to 0.050 mass % or more.

On the other hand, in the case where the total for V and Nb contents is excessively high, the total amount of Mo and Cr carbides formed is reduced, and thereby the tensile strength is lowered. Accordingly, it is appropriate that the total for V and Nb contents be 0.60 mass % or less. The total for V and Nb contents is adjusted preferably to 0.30 mass % or less.

(10.2) 0.050 mass %≤V≤0.60 mass %

In the present invention, even in the case where the V content is 0.050 mass % or less, sufficient tensile strength and fatigue strength can be secured. However, by incorporation of V in a specified amount or more, M2C type carbides or MC type carbides are formed and they conduce to improvement in hydrogen embrittlement characteristics. In addition, incorporation of V ensures excellent fracture toughness characteristics. These effects can be effectively seen in the case where the V content is 0.050 mass % or more. The V content is adjusted preferably to 0.10 mass % or more.

On the other hand, in the case where the V content is excessively high, the total amount of Mo and Cr carbides formed is reduced, and thereby the tensile strength is lowered. Accordingly, it is appropriate that the V content be 0.60 mass % or less. The V content is adjusted preferably to 0.30 mass % or less.

Adjustment of the V content to 0.050 mass % or more is effective in inhibiting AlN from becoming planar in shape even under the condition of 0.50 mass %≤Al≤2.0 mass %.

(10.3) 0.05 mass %≤Nb≤0.6 mass %

As with V, even in the case where the Nb content is 0.050 mass % or less, sufficient tensile strength and fatigue strength can be secured. However, by incorporation of Nb in a specified amount or more, M2C type carbides or MC type carbides are formed and they conduce to improvement in hydrogen embrittlement characteristics. In addition, incorporation of Nb ensures excellent fracture toughness characteristics. These effects can be effectively seen in the case where the Nb content is 0.050 mass % or more.

On the other hand, in the case where the Nb content is excessively high, the total amount of Mo and Cr carbides formed is reduced, and thereby the tensile strength is lowered. Accordingly, it is appropriate that the Nb content be 0.60 mass % or less. The Nb content is adjusted preferably to 0.30 mass % or less.

Adjustment of the Nb content to 0.050 mass % or more is effective in inhibiting AlN from becoming planar in shape even under the condition of 0.50 mass %≤Al≤2.0 mass %.

(11) 0 mass %≤B≤0.0050 mass % (0.0010 mass %≤B≤0.0050 mass %)

B may be added because it is an element effective in improving hot workability of steel. In addition, incorporation of B conduces to improvement in toughness and ductility. This is because B brings about segregation within the grain boundary and inhibits segregation of S within the grain boundary. This effect can be seen in the case where the B content is 0.0010 mass % or more. That is, the B content may be zero (B=0 mass %), but for the purpose of producing such an effect, it is preferred that the B content be 0.0010 mass % or more.

On the other hand, in the case where the B content is excessively high, B combines with N to form BN and degrades toughness and ductility. Accordingly, it is appropriate that the B content be at most 0.0050 mass %.

(12) 0 mass %≤Si≤1.0 mass % (0.10 mass %≤Si≤1.0 mass %)

Si acts as a deoxidizing agent at the time of melting, and lessens oxygen included as an impurity. In addition, Si contributes to enhancement of tensile strength through the solid solution strengthening. Further, the higher the Si content is, the higher the probability that shape of AlN precipitates changes from planar to spherical, and the more likely variations in low-cycle fatigue characteristics are to be controlled. These effects can be seen in the case where the Si content is 0.10 mass % or more, preferably 0.30 mass % or more. That is, the Si content may be zero (Si=0 mass %), but for the purpose of producing such an effect, it is preferred that the Si content be 0.10 mass % or more.

On the other hand, too high Si content not only brings about lowering of hot workability to result in aggravation of fracture in the forging process but also makes the strength excessively high to result in lowering of toughness and ductility. Accordingly, it is appropriate that the Si content be at most 1.0 mass %.

[1.3. Constituent Balance]

It is preferable that, besides having the contents of constituent elements in the foregoing ranges, respectively, the maraging steel of the first case according to the present invention where the contents of V and Nb satisfy V+Nb≤0.020 mass %, satisfies the following relational expression (1):

$$\text{Parameter } X \geq 45 \quad (1)$$

In addition, it is preferable that, besides having the contents of constituent elements in the foregoing ranges, respectively, the maraging steel of the second case according to the present invention where the contents of V and Nb satisfy 0.020 mass %<V+Nb≤0.60 mass %, satisfies the following relational expression (2):

$$\text{Parameter } X \geq 10 \quad (2)$$

In the relational expressions (1) and (2), X=5.5[C]+11.6[Si]−1.4[Ni]−5[Cr]−1.2[Mo]+0.7[Co]+41.9[Al]−7[V]−98.4[Nb]+3.3[B], and each element symbol with braces represents the content (by mass %) of each element.

Each of the relational expressions (1) and (2) is an empirical formula representing the balance of constituent elements which is required to stabilize low-cycle fatigue strength at a high level. Within the range of constituent elements according to the present invention, AlN is conceived as an inclusion affecting the low-cycle fatigue characteristics. Most of AlN precipitates are massive or planar in shape. Among AlN precipitates, those having a planar shape, notably a thin tabular shape with a high aspect ratio, affect adversely the low-cycle fatigue characteristics.

More specifically, the AlN precipitates which produce adverse effects are AlN precipitates having the geometry of a tablet such that its minor axis is 1.0 μm or smaller and its aspect ratio (major axis/minor axis ratio) is 10 or larger when the surface of a metal texture is observed under SEM. It is appropriate that, when observed under SEM, such tabular AlN precipitates be present to the number of 6 or less for every 100 $mm^2$. The number of the tabular AlN precipitates is preferably 4 or less, far preferably 2 or less, and particularly preferably 0, for every 100 $mm^2$. By reducing the number of tabular AlN precipitates, it becomes possible to produce maraging steel which excels in low-cycle fatigue characteristics.

The greater the value of X is, the less prone AlN precipitates are to have a tabular shape (the more likely AlN precipitates are to become massive in shape). Therefore, the greater the value of X is, the more likely variations in low-cycle fatigue characteristics are to be controlled. In order to stabilize the low-cycle fatigue characteristics at a high level by dint of such an effect, it is appropriate that the value of X be 45 or more in the first case (a) where the total for V and Nb contents is 0.020 mass % or less.

On the other hand, in the second case (b) where the total for V and Nb contents satisfies the expression 0.020 mass %<V+Nb≤0.60 mass %, the grain boundary of prior austenite is made fine, and even when AlN precipitates out in the shape of a tablet, the growth in the length direction is inhibited, and thereby it becomes difficult to form AlN precipitates with a high aspect ratio. Accordingly, the value of X can be defined as 10 or more.

Figure 2:
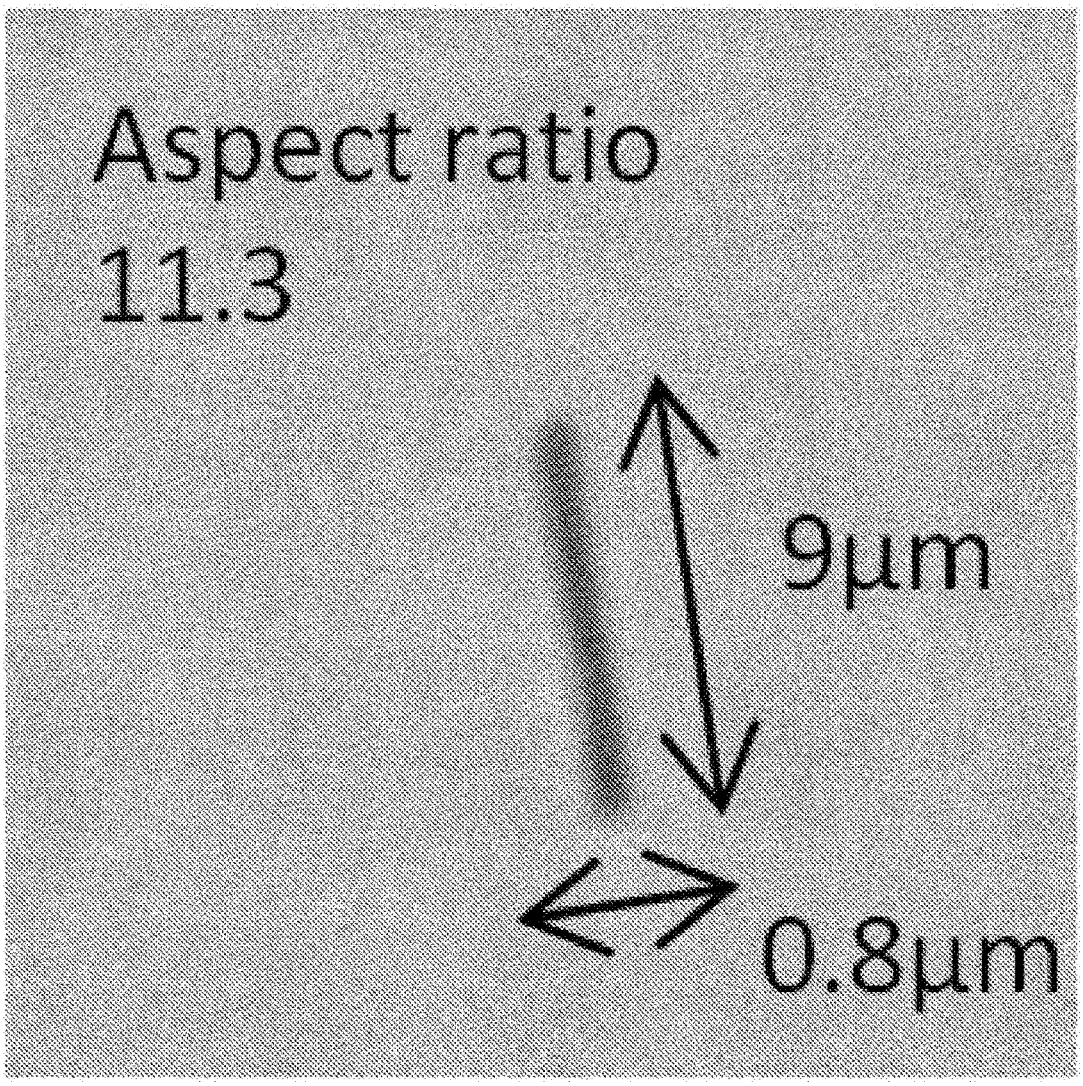
FIG. 2 is an SEM photograph of a tabular AlN particle.

Herein, SEM photographs of a massive AlN precipitate and a tabular AlN precipitate are shown in FIG. 1 and FIG. 2, respectively. The numeric values in each of FIG. 1 and FIG. 2 indicate the length of a minor axis, the length of a major axis and the aspect ratio.

Figure 3:
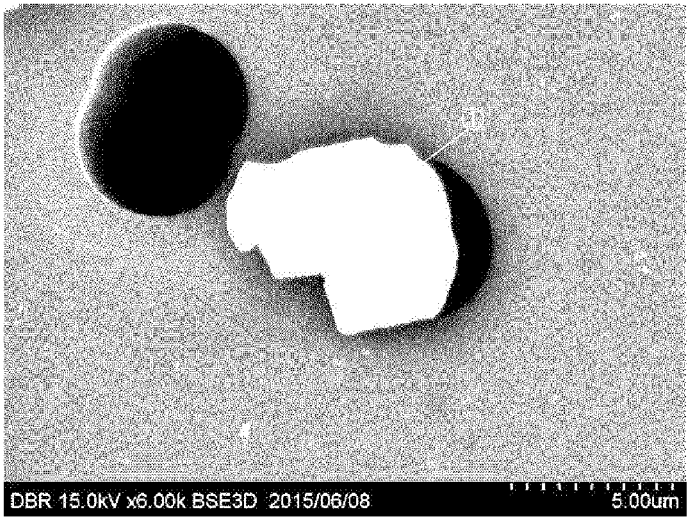
FIG. 3 is an SEM photograph of a massive AlN particle extracted by a chemical extraction experiment.
Figure 4:
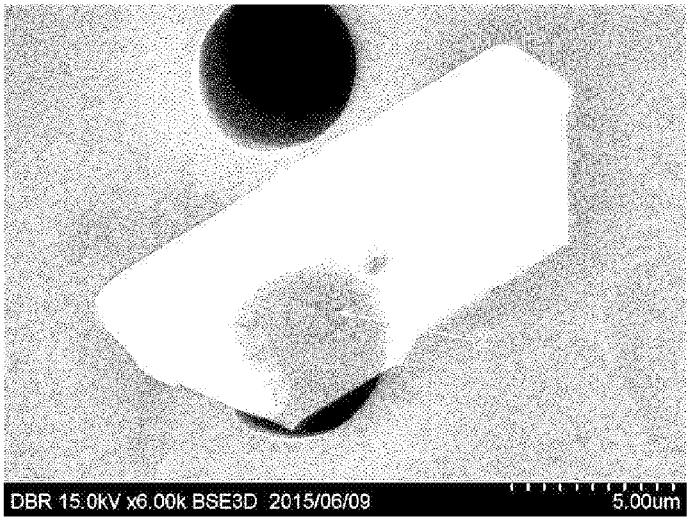
FIG. 4 is an SEM photograph of a tabular AlN particle extracted by a chemical extraction experiment.

In addition, SEM photographs of a massive AlN precipitate and a tabular AlN precipitate, which are extracted by chemical extraction testing, are shown in FIG. 3 and FIG. 4, respectively. The chemical extraction testing may be performed by, for example, taking a test specimen, removing accretion on the surface thereof by pickling, chemically dissolving the resulting test specimen with bromine methanol, and then filtering the dissolved specimen by means of an extraction filter having a pore diameter ϕ of about 5 μm. In the case of a massive AlN precipitate, the filter pore underneath the AlN precipitate is not seen through the AlN precipitate (FIG. 3). On the other hand, in the case where the thickness (minor axis) of an AlN precipitate is thin (e.g. 1.0 μm or smaller), the filter pore underneath the AlN precipitate is seen through the AlN precipitate (FIG. 4). Accordingly, observation results as to whether or not AlN precipitates are transparent on extraction filter's pores can be used as simple evaluation criteria of tabular AlN precipitates.

[2. Manufacturing Method for Maraging Steel]

A manufacturing method for maraging steels according to the present invention contains a melting step, a re-melting step, a homogenizing step, a forging step, a solution heat treatment step, a sub-zero treatment step and an aging treatment step.

[2.1. Melting Step]

The melting step is a step of melting and casting a raw material prepared by mixing constituent elements in respectively-specified content ranges. The raw material to be used has no particular restrictions as to its background and conditions for melting and casting thereof, and it can be selected from those best suited for intended purposes. For the obtainment of maraging steels exceling in strength and fatigue resistance in particular, cleanliness enhancement of the steels is favorable. For achievement of such a purpose, it is appropriate that the melting of a raw material be carried out under vacuum (e.g. by a method of using a vacuum induction melting furnace).

[2.2. Re-melting Step]

The re-melting step is a step in which the ingot obtained in the melting step is subjected to melting and casting once again. This step is not necessarily required, but steel's cleanliness can be further enhanced by carrying out re-melting, and thereby the fatigue resistance of steel is improved. For achievement of such effects, it is appropriate that the re-melting be carried out under vacuum (e.g. according to a vacuum arc re-melting method), and besides, it be repeated several times.

[2.3. Homogenizing Step]

The homogenizing step is a step of heating the ingot obtained in the melting step or the re-melting step at a specified temperature. The heat treatment for homogenization is carried out for the purpose of removing segregation having occurred during the casting. Heat treatment conditions for homogenization are not particularly limited, and any conditions will do, as long as they allow elimination of solidifying segregation. As to the heat treatment conditions for homogenization, the heating temperature is generally from 1,150° C. to 1,350° C., and the heating time is generally at least 10 hours. The ingot after the heat treatment for homogenization is generally air-cooled or sent off to the next step as it is in a red hot state.

[2.4. Forging Step]

The forging step is a step in which the ingot after the heat treatment for homogenization is forged into a predetermined shape. The forging is generally carried out in a hot state. As to the hot forging conditions, the heating temperature is generally from 900° C. to 1,350° C., the heating time is generally at least one hour and the termination temperature is generally 800° C. or higher. The method for cooling after hot forging has no particular restrictions. The hot forging may be carried out at a time, or it may be divided into 4 to 5 steps and performed in succession.

After the forging, annealing is done as required. As to the annealing conditions in ordinary cases, the heating temperature is from 550° C. to 950° C., the heating time is from 1 hour to 36 hours, and the cooling method is air cooling.

[2.5. Solution Heat Treatment Step]

The solution heat treatment step is a step of heating the steel worked into the predetermined shape at a specified temperature. This step is carried out for the purpose of transforming the matrix into the γ-phase alone, and besides converting precipitates, such as Mo carbides, into solid solution. For the solution heat treatment, optimum conditions are selected in response to the steel composition. As to the conditions for solution heat treatment in ordinary cases, the heating temperature is from 800° C. to 1,200° C., the heating time is from 1 hour to 10 hours and the cooling method is air cooling (AC), blast cooling (BC), water cooling (WC) or oil cooling (OC).

[2.6. Sub-Zero Treatment]

The sub-zero treatment is a step for cooling the steel after having received the solution heat treatment to room temperature (23° C.) or lower. This treatment is carried out for the purpose of transforming the remaining γ-phase into the martensite phase. Maraging steels are low in Ms point, and hence a great quantity of γ-phase usually remains at the time of cooling the steels to room temperature (23° C.). Even if maraging steels are subjected to aging treatment as a great quantity of γ-phase remains therein, there will be no expectation of significant increase in strength. Thus it becomes necessary to transform the remaining γ-phase into the martensite phase by performing the sub-zero treatment after the solution heat treatment. As to conditions for the sub-zero treatment in ordinary cases, the cooling temperature is from −197° C. to −73° C. and the cooling time is from 1 hour to 10 hours.

[2.7. Aging Treatment]

The aging treatment is a step for subjecting the steel having been transformed into the martensite phase to heating at a specified temperature. This treatment is carried out for the purpose of precipitating carbides such as $Mo_2C$ as well as intermetallic compounds such as $Ni_3Mo$ and NiAl. For the aging treatment, optimum conditions are selected according to the steel composition. As to the conditions for aging treatment in ordinary cases, the aging treatment temperature is from 400° C. to 600° C., the aging treatment time is from 0.5 hour to 24 hours and the cooling method is air cooling.

[3. Action of Maraging Steel]

With the percentage of each primary element content being confined to the range specified above, and preferably, at the same time, with the individual content range of each element being optimized so as to satisfy the relational expression (1) or (2), it is possible to control the form (precipitate geometry) of AlN which is supposed to be inclusion affecting low-cycle fatigue characteristics. Thus the maraging steels obtained can have a tensile strength of 2,300 MPa or higher, an elongation of 8% or larger and fatigue characteristics stabilized at a high level.

In the case of making engine shafts by the use of the maraging steels according to the present invention in particular, it is possible to make engine shafts excellent in low-cycle fatigue characteristics. This is because, in regard to AlN inclusions having minor axes of 1.0 μm or smaller and aspect ratios of 10 or larger, the maraging steels according to the present invention make it possible to reduce the number of such AlN inclusions to 6 or less, preferably 2 or less, for every 100 $mm^2$ of the plane parallel to the length direction of the engine shaft.

EXAMPLES

Examples 1 to 26 and Comparative Examples 1 to 25

[1. Preparation of Test Specimens]

Each of steels having the chemical compositions shown in Table 1 and Table 2 was melted with vacuum induction melting furnace (VIF) and cast into 50 kg of steel ingot. Each of the thus obtained VIF steel ingots was subjected to homogenization treatment under the condition of 1,200° C.×20 hours. After the treatment, part of each steel ingot was forged into square bars measuring 70 mm per side for use as fracture toughness test specimens and the remainder was forged into round bars measuring ϕ22 for use as other test specimens. After the forging, all the test specimens were subjected to annealing treatment under the condition of 650° C.×16 hours for the purpose of softening them.

Then, solution conversion treatment under conditions of 900° C.×1 hour/air cooling, sub-zero treatment under conditions of −100° C.×1 hour and aging treatment were carried out in sequence. Conditions for the aging treatment were (a) 525° C.×9 hours in Examples 1 to 26, 51 to 54 and 72, and Comparative Examples 1 to 25 and 55, while they were (b) 450° C.×5 hours in Examples 55 to 71 and 73 to 82, and Comparative Examples 51 to 54 and 56 to 73.

TABLE 1

| | Composition (mass %) | | | | | | | | | | | | | | | Parameter | Ni/ | Mo + |
|---|---|---|---|---|---|---|---|---|---|---|---|---|---|---|---|---|---|---|
| | C | Si | S | Ni | Cr | Mo | Co | Ti | Al | V | Nb | W | B | N | Fe | X | Al | W/2 |
| Ex. 1 | 0.22 | 0.08 | 0.0005 | 8.4 | 2.4 | 1.5 | 15.8 | 0.006 | 1.48 | | | | | 0.0006 | balance | 49.7 | 5.7 | 1.5 |
| Ex. 2 | 0.12 | 0.03 | 0.0002 | 8.4 | 2.2 | 1.6 | 15.0 | 0.007 | 1.54 | | | | | 0.0005 | balance | 51.4 | 5.5 | 1.6 |
| Ex. 3 | 0.27 | 0.02 | 0.0002 | 8.4 | 2.1 | 1.5 | 14.6 | 0.009 | 1.48 | | | | | 0.0007 | balance | 49.9 | 5.7 | 1.5 |
| Ex. 4 | 0.33 | 0.06 | 0.0002 | 8.9 | 2.8 | 1.5 | 15.6 | 0.004 | 1.52 | | | | | 0.0009 | balance | 48.9 | 5.9 | 1.5 |
| Ex. 5 | 0.23 | 0.32 | 0.0002 | 8.4 | 2.7 | 1.3 | 15.5 | 0.004 | 1.55 | | | | | 0.0005 | balance | 54.0 | 5.4 | 1.3 |
| Ex. 6 | 0.21 | 0.52 | 0.0003 | 9.2 | 2.3 | 1.3 | 14.0 | 0.005 | 1.45 | | | | | 0.0006 | balance | 51.8 | 6.3 | 1.3 |
| Ex. 7 | 0.23 | 0.91 | 0.0004 | 8.5 | 2.4 | 1.3 | 14.0 | 0.005 | 1.56 | | | | | 0.0007 | balance | 61.5 | 5.4 | 1.3 |
| Ex. 8 | 0.22 | 0.08 | 0.0008 | 9.2 | 2.6 | 1.6 | 14.1 | 0.001 | 1.53 | | | | | 0.0005 | balance | 48.3 | 6.0 | 1.6 |
| Ex. 9 | 0.21 | 0.06 | 0.0002 | 6.1 | 2.7 | 1.3 | 14.7 | 0.009 | 1.49 | | | | | 0.0011 | balance | 51.0 | 4.1 | 1.3 |
| Ex. 10 | 0.21 | 0.01 | 0.0001 | 7.4 | 2.7 | 1.6 | 14.2 | 0.010 | 1.47 | | | | | 0.0011 | balance | 47.0 | 5.0 | 1.6 |
| Ex. 11 | 0.22 | 0.03 | 0.0001 | 8.8 | 1.2 | 1.3 | 15.2 | 0.004 | 1.60 | | | | | 0.0007 | balance | 59.4 | 5.5 | 1.3 |
| Ex. 12 | 0.23 | 0.05 | 0.0004 | 8.9 | 3.7 | 1.3 | 15.1 | 0.002 | 1.61 | | | | | 0.0008 | balance | 47.4 | 5.5 | 1.3 |
| Ex. 13 | 0.22 | 0.08 | 0.0002 | 9.0 | 2.1 | 1.1 | 15.2 | 0.002 | 1.59 | | | | | 0.0004 | balance | 55.0 | 5.7 | 1.1 |
| Ex. 14 | 0.21 | 0.05 | 0.0004 | 8.6 | 2.4 | 1.9 | 14.4 | 0.008 | 1.48 | | | | | 0.0008 | balance | 47.5 | 5.8 | 1.9 |
| Ex. 15 | 0.22 | 0.05 | 0.0001 | 9.1 | 2.4 | 1.5 | 9.8 | 0.005 | 1.56 | | | | | 0.0008 | balance | 47.5 | 5.8 | 1.5 |
| Ex. 16 | 0.23 | 0.02 | 0.0003 | 9.0 | 2.5 | 1.5 | 12.1 | 0.002 | 1.51 | | | | | 0.0007 | balance | 46.3 | 6.0 | 1.5 |
| Ex. 17 | 0.21 | 0.02 | 0.0002 | 9.1 | 2.6 | 1.5 | 19.3 | 0.010 | 1.54 | | | | | 0.0008 | balance | 51.9 | 5.9 | 1.5 |
| Ex. 18 | 0.22 | 0.01 | 0.0003 | 9.3 | 2.6 | 1.6 | 14.5 | 0.010 | 1.43 | | | | | 0.0003 | balance | 43.5 | 6.5 | 1.6 |
| Ex. 19 | 0.22 | 0.08 | 0.0002 | 8.5 | 2.8 | 1.4 | 14.3 | 0.002 | 1.76 | | | | | 0.0007 | balance | 58.3 | 4.8 | 1.4 |
| Ex. 20 | 0.21 | 0.07 | 0.0005 | 8.5 | 2.2 | 1.6 | 14.4 | 0.009 | 1.49 | 0.12 | | | | 0.0006 | balance | 48.8 | 5.7 | 1.6 |
| Ex. 21 | 0.22 | 0.03 | 0.0005 | 8.5 | 2.2 | 1.6 | 14.0 | 0.005 | 1.46 | 0.21 | | | | 0.0004 | balance | 46.2 | 5.8 | 1.6 |
| Ex. 22 | 0.22 | 0.02 | 0.0005 | 9.1 | 2.5 | 1.4 | 15.2 | 0.004 | 1.63 | | 0.08 | | | 0.0003 | balance | 45.6 | 5.6 | 1.4 |
| Ex. 23 | 0.23 | 0.05 | 0.0004 | 9.0 | 2.3 | 1.2 | 14.3 | 0.006 | 1.53 | | | | 0.004 | 0.0010 | balance | 50.4 | 5.9 | 1.2 |
| Ex. 24 | 0.21 | 0.05 | 0.0001 | 9.0 | 2.4 | 1.6 | 15.5 | 0.003 | 1.58 | | | | | 0.0016 | balance | 52.3 | 5.7 | 1.6 |
| Ex. 25 | 0.21 | 0.08 | 0.0002 | 9.3 | 2.4 | 1.0 | 15.2 | 0.004 | 1.53 | | | 0.8 | | 0.0007 | balance | 50.6 | 6.1 | 1.4 |
| Ex. 26 | 0.22 | 0.05 | 0.0005 | 8.5 | 2.5 | 0.6 | 14.3 | 0.005 | 1.49 | | | 1.7 | | 0.0008 | balance | 49.1 | 5.7 | 1.5 |

TABLE 2

| | Composition (mass %) | | | | | | | | | | | | | | | | | Mo + |
|---|---|---|---|---|---|---|---|---|---|---|---|---|---|---|---|---|---|---|
| | C | Si | S | Ni | Cr | Mo | Co | Ti | Al | V | Nb | W | B | N | Fe | Parameter X | Ni/Al | W/2 |
| Comp. 1 | 0.09 | 0.03 | 0.0004 | 8.6 | 2.7 | 1.2 | 14.8 | 0.009 | 1.54 | | | | | 0.0017 | balance | 48.7 | 5.6 | 1.2 |
| Comp. 2 | 0.36 | 0.01 | 0.0003 | 9.2 | 2.2 | 1.2 | 16.0 | 0.010 | 1.47 | | | | | 0.0006 | balance | 49.6 | 6.3 | 1.2 |
| Comp. 3 | 0.23 | 1.12 | 0.0005 | 9.2 | 2.4 | 1.3 | 15.1 | 0.003 | 1.58 | | | | | 0.0011 | balance | 64.6 | 5.8 | 1.3 |
| Comp. 4 | 0.22 | 0.08 | 0.0012 | 9.3 | 2.5 | 1.5 | 14.6 | 0.009 | 1.54 | | | | | 0.0006 | balance | 49.6 | 6.0 | 1.5 |
| Comp. 5 | 0.23 | 0.08 | 0.0005 | 5.8 | 2.7 | 1.4 | 15.1 | 0.009 | 1.56 | | | | | 0.0004 | balance | 54.8 | 3.7 | 1.4 |
| Comp. 6 | 0.21 | 0.03 | 0.0005 | 9.7 | 2.7 | 1.4 | 15.7 | 0.002 | 1.58 | | | | | 0.0006 | balance | 49.9 | 6.1 | 1.4 |
| Comp. 7 | 0.22 | 0.08 | 0.0005 | 8.3 | 0.8 | 1.3 | 14.1 | 0.009 | 1.54 | | | | | 0.0006 | balance | 59.4 | 5.4 | 1.3 |
| Comp. 8 | 0.22 | 0.06 | 0.0002 | 8.6 | 4.1 | 1.6 | 15.3 | 0.007 | 1.58 | | | | | 0.0005 | balance | 44.4 | 5.4 | 1.6 |
| Comp. 9 | 0.23 | 0.07 | 0.0003 | 9.1 | 2.7 | 0.9 | 14.4 | 0.006 | 1.49 | | | | | 0.0007 | balance | 47.3 | 6.1 | 0.9 |
| Comp. 10 | 0.22 | 0.03 | 0.0005 | 8.3 | 2.1 | 2.1 | 14.3 | 0.002 | 1.50 | | | | | 0.0007 | balance | 49.8 | 5.5 | 2.1 |
| Comp. 11 | 0.22 | 0.04 | 0.0006 | 9.1 | 2.5 | 1.2 | 8.7 | 0.008 | 1.55 | | | | | 0.0004 | balance | 46.0 | 5.9 | 1.2 |
| Comp. 12 | 0.21 | 0.05 | 0.0003 | 9.3 | 2.3 | 1.4 | 20.4 | 0.005 | 1.55 | | | | | 0.001 | balance | 54.8 | 6.0 | 1.4 |
| Comp. 13 | 0.23 | 0.05 | 0.0006 | 9.1 | 2.5 | 1.6 | 14.7 | 0.114 | 1.53 | | | | | 0.0008 | balance | 49.1 | 5.9 | 1.6 |
| Comp. 14 | 0.23 | 0.07 | 0.0007 | 8.6 | 2.7 | 1.3 | 15.7 | 0.009 | 1.28 | | | | | 0.0007 | balance | 39.6 | 6.7 | 1.3 |
| Comp. 15 | 0.23 | 0.07 | 0.0003 | 9.1 | 2.6 | 1.2 | 14.0 | 0.010 | 2.08 | | | | | 0.0006 | balance | 71.8 | 4.4 | 1.2 |
| Comp. 16 | 0.23 | 0.07 | 0.0006 | 8.3 | 2.5 | 1.4 | 14.1 | 0.003 | 1.49 | 0.68 | | | | 0.0005 | balance | 43.8 | 5.6 | 1.4 |
| Comp. 17 | 0.22 | 0.06 | 0.0006 | 8.3 | 2.1 | 1.5 | 14.8 | 0.008 | 1.47 | | 0.66 | | | 0.0012 | balance | −15.0 | 5.6 | 1.5 |
| Comp. 18 | 0.23 | 0.03 | 0.0006 | 8.4 | 2.4 | 1.5 | 15.9 | 0.001 | 1.51 | | | | 0.007 | 0.0005 | balance | 50.5 | 5.6 | 1.5 |
| Comp. 19 | 0.23 | 0.06 | 0.0008 | 9.0 | 2.1 | 1.6 | 14.9 | 0.003 | 1.55 | | | | | 0.0022 | balance | 52.3 | 5.8 | 1.6 |
| Comp. 20 | 0.22 | 0.08 | 0.0003 | 8.8 | 4.0 | 3.0 | 15.0 | 0.003 | 1.00 | | | | | 0.0007 | balance | 18.6 | 8.8 | 3.0 |
| Comp. 21 | 0.23 | 0.04 | 0.0004 | 13.0 | 3.3 | 1.5 | 6.1 | 0.004 | 1.51 | 0.21 | | | | 0.0008 | balance | 31.3 | 8.6 | 1.5 |
| Comp. 22 | 0.22 | 0.04 | 0.0003 | 13.8 | 2.4 | 1.4 | 10.2 | 0.003 | 0.97 | | | | | 0.0007 | balance | 16.5 | 14.2 | 1.4 |
| Comp. 23 | 0.23 | 0.07 | 0.0003 | 9.1 | 2.5 | 1.4 | 14.8 | 0.008 | 1.51 | | | 2.2 | | 0.0007 | balance | 48.8 | 6.0 | 2.5 |
| Comp. 24 | 0.22 | 0.08 | 0.0002 | 8.6 | 2.7 | 0.6 | 14.7 | 0.010 | 1.49 | | | 0.6 | | 0.0008 | balance | 48.6 | 5.8 | 0.9 |
| Comp. 25 | 0.23 | 0.03 | 0.0006 | 8.3 | 2.6 | 1.4 | 15.3 | 0.007 | 1.50 | | | 1.6 | | 0.0005 | balance | 48.9 | 5.5 | 2.2 |

[2. Testing Methods]

[2.1. Hardness]

Hardness measurements were made in accordance with the Vickers hardness testing method defined in JIS Z 2244: 2009. The measurements were carried out under a load of 4.9N at positions of one-fourth the diameter of a ϕ22 round bar. The average of values measured at 5 points was adopted as hardness.

[2.2. Tensile Testing]

Tensile testing was carried out in accordance with the metal tensile testing method defined in JIS Z 2241:2011. The testing temperature adopted herein was room temperature (23° C.).

[2.3. Low-cycle Fatigue (LCF) Testing]

Materials for test specimens were taken so that the length directions of test specimens were parallel to the directions of extension during the forging of the materials, and therefrom test specimens were made according to JIS law (JIS Z 2242:2005). By the use of these test specimens, the testing was carried out. The temperature during the testing was set at 200° C. In addition, a triangular form was chosen as the skew waveform, and the frequency setting was adjusted to 0.1 Hz and the distortion setting was adjusted to 0.9%.

[2.4. Observation Under SEM]

Test specimens each measuring 10 mm per side were taken, and observation faces corresponding to planes parallel to the length directions of the round bar materials were polished to a mirror-smooth state. The whole area (100 $mm^2$) of each face was observed under SEM (Scanning Electron Microscope), and examined for inclusions. In order to identify the inclusions, EDX analysis was conducted.

AlN inclusions having minor axes (thickness) of 1.0 μm or smaller and aspect ratios (major axis/minor axis ratios) of 10 or larger were counted, and the number of such AlN inclusions present in the area of 100 $mm^2$ was determined.

[2.5. Fracture Toughness Testing]

Materials for test specimens were taken so that the notch directions of test specimens were parallel to the directions of extension during the forging of the materials, and therefrom compact tension (CT) test specimens were made according to ASTM law (ASTM E399). By the use of these test specimens, the testing was conducted and values of fracture toughness $K_{1C}$ were determined. As the testing temperature, room temperature (23° C.) was chosen.

[3. Results]

Results obtained are shown in Table 3 and Table 4. The following can be seen from Table 3 and Table 4. (1) In the case where C contents are low, though the elongation becomes great, the hardness and the tensile strength become low. On the other hand, in the case where C contents are excessively high, though the hardness and the tensile strength become high, the elongation becomes small. In contrast to these tendencies, optimizations of C contents performed concurrently with optimizations of other element contents allow achievement of the compatibility between high strength, high elongation and high fatigue resistance. (2) In the case where Ni, Co, Mo and Al contents relating to precipitation amounts of intermetallic compounds and carbides are too low, the tensile strength tends to become low. In contrast to this tendency, optimizations of these element contents performed concurrently with optimizations of other element contents allow achievement of the compatibility between high strength, high elongation and high fatigue resistance.

(3) In the case where Cr contents are low, though high strength is obtained, the elongation becomes small. On the other hand, in the case where Cr contents are excessively high, though large elongation is obtained, strength becomes low. In contrast to these tendencies, optimizations of Cr contents performed concurrently with optimization of other element contents allow achievement of the compatibility between high strength, high elongation and high fatigue resistance. In addition, control of Cr contents to 3.5 mass % or low makes it possible to obtain not only high strength, high elongation and high fatigue resistance but also high fracture toughness. (4) In the case where the X value is small, though the elongation becomes high, the strength becomes low. In addition, AlN inclusions increase in number and fatigue characteristics are degraded. On the other hand, if the X value becomes 45 or larger in the cases where the total for V and Nb contents is 0.020 mass % or lower, or if the X value becomes 10 or larger in the cases where the total for V and Nb contents is higher than 0.020 mass %, it becomes possible to achieve the compatibility between high strength, high elongation, high fracture toughness, and high fatigue resistance.

Examples 51 to 82 and Comparative Examples 51 to 73

[1. Preparation of Test Specimens and Testing Methods]

Test specimens were made in the same manners as in Example 1, except that alloys having the compositions shown in Tables 5 to 8 were used. On the specimens thus made, evaluations of their characteristics were performed

TABLE 3

| | Hardness (HV) | Tensile Testing: Tensile strength (MPa) | Tensile Testing: Elongation (%) | LCF Fracture Life $\times 10^4$ (cycle) | Number of AlN Precipitates with Thickness ≤1.0 μm and Aspect ratio ≥10 | Fracture Toughness Value (MPa√m) |
|---|---|---|---|---|---|---|
| Ex. 1 | 672 | 2345 | 11 | >20 | 0 | 28 |
| Ex. 2 | 666 | 2304 | 12 | >20 | 0 | 26 |
| Ex. 3 | 678 | 2360 | 10 | >20 | 0 | 27 |
| Ex. 4 | 687 | 2387 | 8 | >20 | 0 | 29 |
| Ex. 5 | 683 | 2360 | 10 | >20 | 0 | 27 |
| Ex. 6 | 681 | 2385 | 9 | >20 | 0 | 26 |
| Ex. 7 | 698 | 2426 | 8 | >20 | 0 | 25 |
| Ex. 8 | 674 | 2342 | 10 | >20 | 0 | 28 |
| Ex. 9 | 659 | 2310 | 10 | >20 | 0 | 26 |
| Ex. 10 | 672 | 2336 | 11 | >20 | 0 | 26 |
| Ex. 11 | 677 | 2351 | 8 | >20 | 0 | 28 |
| Ex. 12 | 668 | 2321 | 11 | >20 | 0 | 23 |
| Ex. 13 | 671 | 2318 | 13 | >20 | 0 | 30 |
| Ex. 14 | 689 | 2391 | 8 | >20 | 0 | 27 |
| Ex. 15 | 662 | 2320 | 13 | >20 | 0 | 29 |
| Ex. 16 | 672 | 2335 | 12 | >20 | 0 | 28 |
| Ex. 17 | 688 | 2390 | 8 | >20 | 0 | 28 |
| Ex. 18 | 683 | 2321 | 11 | >20 | 2 | 29 |
| Ex. 19 | 692 | 2376 | 9 | >20 | 0 | 26 |
| Ex. 20 | 667 | 2327 | 12 | >20 | 0 | 31 |
| Ex. 21 | 659 | 2310 | 11 | >20 | 0 | 31 |
| Ex. 22 | 668 | 2332 | 10 | >20 | 0 | 30 |
| Ex. 13 | 678 | 2355 | 10 | >20 | 0 | 33 |
| Ex. 24 | 674 | 2342 | 9 | >20 | 0 | 28 |
| Ex. 25 | 668 | 2362 | 9 | >20 | 0 | 35 |
| Ex. 26 | 681 | 2384 | 8 | >20 | 0 | 33 |

TABLE 4

| | Hardness (HV) | Tensile Testing: Tensile strength (MPa) | Tensile Testing: Elongation (%) | LCF Fracture Life $\times 10^4$ (cycle) | Number of AlN Precipitates with Thickness ≤1.0 μm and Aspect ratio ≥10 | Fracture Toughness Value (MPa√m) |
|---|---|---|---|---|---|---|
| Comp. Ex. 1 | 649 | 2274 | 13 | >20 | 0 | 34 |
| Comp. Ex. 2 | 693 | 2433 | 7 | >20 | 0 | 24 |
| Comp. Ex. 3 | 702 | 2453 | 6 | >20 | 0 | 23 |
| Comp. Ex. 4 | 658 | 2270 | 9 | 6 | 0 | 24 |
| Comp. Ex. 5 | 661 | 2282 | 9 | >20 | 0 | 25 |
| Comp. Ex. 6 | 649 | 2275 | 14 | >20 | 0 | 36 |
| Comp. Ex. 7 | 680 | 2355 | 6 | >20 | 0 | 22 |
| Comp. Ex. 8 | 660 | 2283 | 12 | 15 | 5 | 20 |
| Comp. Ex. 9 | 638 | 2235 | 14 | >20 | 0 | 33 |
| Comp. Ex. 10 | 692 | 2424 | 6 | >20 | 0 | 22 |
| Comp. Ex. 11 | 660 | 2276 | 14 | >20 | 0 | 34 |
| Comp. Ex. 12 | 691 | 2415 | 6 | >20 | 0 | 23 |
| Comp. Ex. 13 | 673 | 2348 | 10 | 3 | 0 | 30 |
| Comp. Ex. 14 | 644 | 2256 | 12 | 9 | 7 | 29 |
| Comp. Ex. 15 | 694 | 2426 | 5 | >20 | 0 | 21 |
| Comp. Ex. 16 | 647 | 2253 | 11 | >20 | 2 | 28 |
| Comp. Ex. 17 | 647 | 2243 | 9 | 7 | 23 | 27 |
| Comp. Ex. 18 | 675 | 2351 | 7 | >20 | 0 | 24 |
| Comp. Ex. 19 | 675 | 2350 | 7 | 7 | 0 | 23 |
| Comp. Ex. 20 | 701 | 2445 | 7 | 3 | 31 | 24 |
| Comp. Ex. 21 | 658 | 2288 | 12 | 11 | 9 | 29 |
| Comp. Ex. 22 | 602 | 2084 | 14 | 10 | 13 | 65 |
| Comp. Ex. 23 | 684 | 2373 | 5 | >20 | 0 | 22 |
| Comp. Ex. 24 | 635 | 2234 | 10 | >20 | 0 | 30 |
| Comp. Ex. 25 | 674 | 2352 | 6 | >20 | 0 | 24 |

according to the same methods as in Example 1. By the way, the compositions in Examples 20 to 22 and those in Comparative Examples 20 to 22 are also listed in Table 5 and Table 8, respectively.

TABLE 5

| | Composition (mass %) | | | | | | | | | | | | | | | | | Mo + |
|---|---|---|---|---|---|---|---|---|---|---|---|---|---|---|---|---|---|---|
| | C | Si | S | Ni | Cr | Mo | Co | Ti | Al | V | Nb | W | B | N | Fe | Parameter X | Ni/Al | W/2 |
| Ex. 20 | 0.21 | 0.07 | 0.0005 | 8.5 | 2.2 | 1.6 | 14.4 | 0.009 | 1.49 | 0.12 | | | | 0.0006 | balance | 48.8 | 5.7 | 1.6 |
| Ex. 21 | 0.22 | 0.03 | 0.0005 | 8.5 | 2.2 | 1.6 | 14.0 | 0.005 | 1.46 | 0.21 | | | | 0.0004 | balance | 46.2 | 5.8 | 1.6 |
| Ex. 22 | 0.22 | 0.02 | 0.0005 | 9.1 | 2.5 | 1.4 | 15.2 | 0.004 | 1.63 | | 0.08 | | | 0.0003 | balance | 45.6 | 5.6 | 1.4 |
| Ex. 51 | 0.23 | 0.08 | 0.0005 | 8.6 | 2.4 | 1.3 | 14.2 | 0.006 | 0.95 | 0.20 | | | | 0.0007 | balance | 24.9 | 9.1 | 1.3 |
| Ex. 52 | 0.22 | 0.05 | 0.0002 | 9.1 | 2.1 | 1.2 | 14.3 | 0.004 | 1.03 | 0.22 | | 0.4 | | 0.0008 | balance | 28.7 | 8.8 | 1.4 |
| Ex. 53 | 0.21 | 0.06 | 0.0005 | 8.3 | 2.8 | 0.9 | 15.6 | 0.009 | 1.01 | 0.18 | | 0.8 | | 0.0007 | balance | 27.1 | 8.2 | 1.3 |
| Ex. 54 | 0.22 | 0.07 | 0.0005 | 9.1 | 2.3 | 0.6 | 14.9 | 0.003 | 0.99 | 0.23 | | 1.6 | | 0.0005 | balance | 27.4 | 9.2 | 1.4 |
| Ex. 55 | 0.23 | 0.07 | 0.0002 | 14.1 | 2.3 | 1.3 | 15.7 | 0.004 | 1.04 | 0.19 | | | | 0.0007 | balance | 22.5 | 13.6 | 1.3 |
| Ex. 56 | 0.11 | 0.02 | 0.0002 | 15.9 | 2.1 | 1.3 | 15.6 | 0.001 | 1.05 | 0.21 | | | | 0.001 | balance | 20.0 | 15.1 | 1.3 |
| Ex. 57 | 0.27 | 0.08 | 0.0002 | 12.9 | 2.1 | 1.6 | 14.7 | 0.009 | 1.00 | 0.14 | 0.07 | | | 0.0003 | balance | 16.3 | 12.9 | 1.6 |
| Ex. 58 | 0.34 | 0.06 | 0.0004 | 13.2 | 2.2 | 1.4 | 15.4 | 0.006 | 1.04 | 0.18 | | | | 0.0006 | balance | 24.5 | 12.7 | 1.4 |
| Ex. 59 | 0.21 | 0.33 | 0.0004 | 13.4 | 2.1 | 1.3 | 14.4 | 0.007 | 0.96 | 0.18 | | | | 0.0012 | balance | 23.2 | 14.0 | 1.3 |
| Ex. 60 | 0.21 | 0.56 | 0.0004 | 15.4 | 2.2 | 1.4 | 15.9 | 0.009 | 0.95 | 0.20 | | | | 0.001 | balance | 22.9 | 16.2 | 1.4 |
| Ex. 61 | 0.23 | 0.92 | 0.0003 | 15.2 | 2.7 | 1.5 | 14.2 | 0.009 | 1.02 | 0.17 | | | | 0.0009 | balance | 26.8 | 14.9 | 1.5 |
| Ex. 62 | 0.23 | 0.01 | 0.0008 | 13.0 | 2.4 | 1.4 | 14.3 | 0.004 | 1.04 | 0.25 | | | | 0.001 | balance | 21.3 | 12.5 | 1.4 |
| Ex. 63 | 0.23 | 0.08 | 0.0003 | 10.1 | 2.3 | 1.3 | 14.2 | 0.009 | 1.02 | 0.22 | | | | 0.0003 | balance | 26.1 | 9.9 | 1.3 |
| Ex. 64 | 0.22 | 0.01 | 0.0005 | 17.8 | 2.3 | 1.4 | 15.6 | 0.004 | 0.95 | 0.16 | | | | 0.0008 | balance | 12.8 | 18.7 | 1.4 |
| Ex. 65 | 0.21 | 0.01 | 0.0003 | 19.6 | 2.2 | 1.5 | 16.0 | 0.003 | 1.02 | 0.21 | | | | 0.0004 | balance | 13.5 | 19.2 | 1.5 |

TABLE 6

| | Composition (mass %) | | | | | | | | | | | | | | | | | Mo + |
|---|---|---|---|---|---|---|---|---|---|---|---|---|---|---|---|---|---|---|
| | C | Si | S | Ni | Cr | Mo | Co | Ti | Al | V | Nb | W | B | N | Fe | Parameter X | Ni/Al | W/2 |
| Ex. 66 | 0.22 | 0.08 | 0.0002 | 15.9 | 1.1 | 1.5 | 15.6 | 0.001 | 1.03 | 0.20 | | | | 0.0012 | balance | 25.3 | 15.4 | 1.5 |
| Ex. 67 | 0.21 | 0.05 | 0.0005 | 15.1 | 3.7 | 1.4 | 15.3 | 0.003 | 1.08 | 0.23 | | | | 0.0012 | balance | 14.8 | 14.0 | 1.4 |
| Ex. 68 | 0.21 | 0.06 | 0.0002 | 13.4 | 2.5 | 1.1 | 14.9 | 0.004 | 0.99 | 0.23 | | | | 0.0007 | balance | 19.6 | 13.5 | 1.1 |
| Ex. 69 | 0.22 | 0.07 | 0.0005 | 14.0 | 2.4 | 1.9 | 14.8 | 0.002 | 1.00 | 0.18 | 0.06 | | | 0.0008 | balance | 13.2 | 14.0 | 1.9 |
| Ex. 70 | 0.23 | 0.06 | 0.0005 | 16.0 | 2.2 | 1.6 | 9.4 | 0.001 | 0.96 | 0.23 | | | | 0.0007 | balance | 11.8 | 16.7 | 1.6 |
| Ex. 71 | 0.23 | 0.05 | 0.0004 | 12.3 | 2.1 | 1.6 | 11.8 | 0.008 | 0.96 | 0.21 | | | | 0.0005 | balance | 19.2 | 12.8 | 1.6 |
| Ex. 72 | 0.21 | 0.06 | 0.0003 | 6.6 | 2.4 | 1.3 | 19.1 | 0.006 | 0.57 | 0.21 | | | | 0.0006 | balance | 14.8 | 11.6 | 1.3 |
| Ex. 73 | 0.23 | 0.01 | 0.0005 | 17.9 | 2.1 | 1.5 | 15.8 | 0.010 | 1.51 | 0.23 | | | | 0.0009 | balance | 36.7 | 11.9 | 1.5 |
| Ex. 74 | 0.23 | 0.02 | 0.0005 | 18.9 | 2.8 | 1.3 | 15.8 | 0.001 | 1.85 | 0.17 | | | | 0.001 | balance | 46.9 | 10.2 | 1.3 |
| Ex. 75 | 0.21 | 0.05 | 0.0002 | 15.4 | 2.3 | 1.6 | 15.4 | 0.01 | 0.97 | 0.12 | | | | 0.0004 | balance | 17.3 | 15.9 | 1.6 |
| Ex. 76 | 0.21 | 0.05 | 0.0003 | 15.4 | 2.7 | 1.3 | 15.1 | 0.008 | 1.05 | 0.54 | | | | 0.0008 | balance | 15.9 | 14.7 | 1.3 |
| Ex. 77 | 0.21 | 0.07 | 0.0004 | 12.8 | 2.7 | 1.4 | 15.2 | 0.004 | 0.95 | | 0.09 | | | 0.0007 | balance | 10.5 | 13.5 | 1.4 |
| Ex. 78 | 0.22 | 0.05 | 0.0005 | 14.2 | 2.3 | 1.2 | 14.9 | 0.003 | 1.02 | 0.19 | | 0.4 | | 0.0008 | balance | 20.8 | 13.9 | 1.4 |
| Ex. 79 | 0.22 | 0.04 | 0.0003 | 13.9 | 2.1 | 1 | 15.7 | 0.004 | 1.03 | 0.25 | | 0.8 | | 0.0008 | balance | 22.9 | 13.5 | 1.4 |
| Ex. 80 | 0.22 | 0.06 | 0.0004 | 15 | 2.1 | 0.5 | 14.1 | 0.002 | 1.02 | 0.24 | | 1.7 | | 0.0005 | balance | 20.7 | 14.7 | 1.4 |
| Ex. 81 | 0.21 | 0.08 | 0.0002 | 15.3 | 2.6 | 1.3 | 14.9 | 0.005 | 1 | 0.25 | | | 0.004 | 0.0004 | balance | 16.7 | 15.3 | 1.3 |
| Ex. 82 | 0.23 | 0.07 | 0.0004 | 12 | 2.8 | 1.5 | 15.5 | 0.004 | 1.01 | 0.21 | | | | 0.0009 | balance | 21.2 | 11.9 | 1.5 |

TABLE 7

| | Composition (mass %) | | | | | | | | | | | | | | | | | |
|---|---|---|---|---|---|---|---|---|---|---|---|---|---|---|---|---|---|---|
| | C | Si | S | Ni | Cr | Mo | Co | Ti | Al | V | Nb | W | B | N | Fe | Parameter X | Ni/Al | Mo + W/2 |
| Comp. 51 | 0.09 | 0.07 | 0.0008 | 14.8 | 2.3 | 1.4 | 15.1 | 0.007 | 0.97 | 0.22 | | | | 0.0010 | balance | 17.1 | 15.3 | 1.4 |
| Comp. 52 | 0.37 | 0.06 | 0.0003 | 13.1 | 2.7 | 1.4 | 14.2 | 0.006 | 1.00 | 0.25 | | | | 0.0010 | balance | 19.3 | 13.1 | 1.4 |
| Comp. 53 | 0.22 | 1.09 | 0.0006 | 13.1 | 2.2 | 1.4 | 14.4 | 0.004 | 1.05 | 0.17 | | | | 0.0012 | balance | 35.7 | 12.5 | 1.4 |
| Comp. 54 | 0.22 | 0.06 | 0.0011 | 13.2 | 2.3 | 1.3 | 15.8 | 0.007 | 0.97 | 0.20 | | | | 0.0007 | balance | 20.7 | 13.6 | 1.3 |
| Comp. 55 | 0.21 | 0.07 | 0.0004 | 5.8 | 2.3 | 1.3 | 14.9 | 0.001 | 0.96 | 0.19 | | | | 0.0004 | balance | 30.1 | 6.0 | 1.3 |
| Comp. 56 | 0.22 | 0.05 | 0.0003 | 20.6 | 2.7 | 1.4 | 14.0 | 0.002 | 0.98 | 0.22 | | | | 0.0009 | balance | 7.1 | 21.0 | 1.4 |
| Comp. 57 | 0.22 | 0.02 | 0.0005 | 15.5 | 0.9 | 1.3 | 15.5 | 0.004 | 0.95 | 0.21 | | | | 0.0009 | balance | 22.9 | 16.3 | 1.3 |
| Comp. 58 | 0.23 | 0.02 | 0.0002 | 12.7 | 4.2 | 1.3 | 15.7 | 0.008 | 0.96 | 0.24 | | | | 0.0011 | balance | 10.7 | 13.2 | 1.3 |
| Comp. 59 | 0.21 | 0.05 | 0.0002 | 16.0 | 2.8 | 0.9 | 14.9 | 0.001 | 0.98 | 0.19 | | | | 0.0006 | balance | 14.4 | 16.3 | 0.9 |
| Comp. 60 | 0.21 | 0.06 | 0.0006 | 14.4 | 2.4 | 2.1 | 15.0 | 0.007 | 1.00 | 0.17 | | | | 0.0003 | balance | 18.4 | 14.4 | 2.1 |
| Comp. 61 | 0.23 | 0.06 | 0.0007 | 12.2 | 2.2 | 1.3 | 8.8 | 0.010 | 1.03 | 0.17 | | | | 0.0011 | balance | 20.4 | 11.8 | 1.3 |
| Comp. 62 | 0.22 | 0.04 | 0.0007 | 15.4 | 2.4 | 1.5 | 20.3 | 0.002 | 1.00 | 0.25 | | | | 0.0009 | balance | 20.7 | 15.4 | 1.5 |
| Comp. 63 | 0.22 | 0.02 | 0.0005 | 15.0 | 2.2 | 1.4 | 15.9 | 0.109 | 1.01 | 0.19 | | | | 0.0007 | balance | 19.9 | 14.9 | 1.4 |
| Comp. 64 | 0.21 | 0.08 | 0.0002 | 12.4 | 2.3 | 1.6 | 14.3 | 0.006 | 0.44 | 0.25 | | | | 0.0010 | balance | −2.0 | 28.2 | 1.6 |
| Comp. 65 | 0.22 | 0.05 | 0.0008 | 12.7 | 2.7 | 1.6 | 15.5 | 0.008 | 2.08 | 0.18 | | | | 0.0005 | balance | 65.3 | 6.1 | 1.6 |

TABLE 8

| | Composition (mass %) | | | | | | | | | | | | | | | | | Mo + |
|---|---|---|---|---|---|---|---|---|---|---|---|---|---|---|---|---|---|---|
| | C | Si | S | Ni | Cr | Mo | Co | Ti | Al | V | Nb | W | B | N | Fe | Parameter X | Ni/Al | W/2 |
| Comp. 66 | 0.21 | 0.08 | 0.0007 | 13.2 | 2.2 | 1.6 | 15.9 | 0.002 | 0.96 | 0.68 | | | | 0.0011 | balance | 17.3 | 13.8 | 1.6 |
| Comp. 67 | 0.23 | 0.06 | 0.0002 | 14.6 | 2.2 | 1.4 | 15.9 | 0.006 | 0.97 | | 0.66 | | | 0.0005 | balance | −44.3 | 15.1 | 1.4 |
| Comp. 68 | 0.21 | 0.02 | 0.0003 | 13.8 | 2.5 | 1.3 | 16.0 | 0.008 | 1.04 | 0.17 | | 2.2 | | 0.0012 | balance | 21.6 | 13.3 | 2.4 |
| Comp. 69 | 0.23 | 0.04 | 0.0003 | 13.9 | 2.4 | 0.6 | 15.3 | 0.002 | 1.02 | 0.19 | | 0.6 | | 0.0007 | balance | 21.7 | 13.6 | 0.9 |
| Comp. 70 | 0.22 | 0.05 | 0.0007 | 14.5 | 2.6 | 1.3 | 14.6 | 0.005 | 1.03 | 0.23 | | 1.6 | | 0.0009 | balance | 18.7 | 14.1 | 2.1 |
| Comp. 71 | 0.23 | 0.06 | 0.0006 | 13.2 | 2.7 | 1.5 | 16.0 | 0.009 | 0.97 | 0.17 | | | 0.007 | 0.0005 | balance | 18.9 | 13.6 | 1.5 |
| Comp. 72 | 0.23 | 0.03 | 0.0006 | 13.7 | 2.4 | 1.3 | 15.3 | 0.009 | 0.99 | 0.24 | | | | 0.0022 | balance | 19.4 | 13.8 | 1.3 |
| Comp. 73 | 0.23 | 0.03 | 0.0007 | 13.9 | 2.2 | 1.4 | 15.0 | 0.005 | 1.03 | | | | | 0.0007 | balance | 23.1 | 13.5 | 1.4 |
| Comp. 20 | 0.22 | 0.08 | 0.0003 | 8.8 | 4.0 | 3.0 | 15.0 | 0.003 | 1.00 | | | | | 0.0007 | balance | 18.6 | 8.8 | 3.0 |
| Comp. 21 | 0.23 | 0.04 | 0.0004 | 13.0 | 3.3 | 1.5 | 6.1 | 0.004 | 1.51 | 0.21 | | | | 0.0008 | balance | 31.3 | 8.6 | 1.5 |
| Comp. 22 | 0.22 | 0.04 | 0.0003 | 13.8 | 2.4 | 1.4 | 10.2 | 0.003 | 0.97 | | | | | 0.0007 | balance | 16.5 | 14.2 | 1.4 |

[2. Results]

Results obtained are shown in Tables 9 to 12. Incidentally, results obtained in Examples 20 to 22 and those obtained in Comparative Examples 20 to 22 are also listed in Table 9 and Table 12, respectively. As can be seen from Tables 9 to 12, among the cases where 0.020 mass %<V+Nb≤0.60 mass %, the Examples where the Ni contents were in a range of 10.0 mass % to 19.0 mass % not only ensure outstanding tensile strength but also deliver excellent fracture toughness (32 MPa√m or higher) as compared with the other Examples where the Ni contents were lower than the foregoing range (Examples 25 to 54 and 72) or higher than the foregoing range (Examples 65). In addition, it can be seen that, compared with Example 67 where Cr is 3.7 mass %, other Examples where Cr is 3.0 mass % or less not only ensure outstanding tensile strength but also deliver excellent fracture toughness (32 MPa√m or higher).

TABLE 9

| | | Tensile Testing | | LCF Fracture | Number of AlN Precipitates | Fracture |
|---|---|---|---|---|---|---|
| | Hardness (HV) | Tensile Strength (MPa) | Elongation (%) | Life $\times 10^4$ (cycle) | with Thickness ≤1.0 μm and Aspect Ratio ≥10 | Toughness Value (MPa√m) |
| Ex. 20 | 667 | 2327 | 12 | >20 | 0 | 31 |
| Ex. 21 | 659 | 2310 | 11 | >20 | 0 | 31 |
| Ex. 22 | 668 | 2332 | 10 | >20 | 0 | 30 |
| Ex. 51 | 667 | 2336 | 11 | >20 | 0 | 27 |
| Ex. 52 | 671 | 2345 | 10 | >20 | 0 | 29 |
| Ex. 53 | 673 | 2356 | 10 | >20 | 0 | 27 |
| Ex. 54 | 671 | 2356 | 9 | >20 | 0 | 26 |
| Ex. 55 | 657 | 2311 | 12 | >20 | 0 | 37 |
| Ex. 56 | 654 | 2320 | 13 | >20 | 0 | 33 |
| Ex. 57 | 663 | 2337 | 10 | >20 | 0 | 36 |
| Ex. 58 | 680 | 2407 | 8 | >20 | 0 | 39 |
| Ex. 59 | 675 | 2385 | 11 | >20 | 0 | 35 |
| Ex. 60 | 668 | 2357 | 8 | >20 | 0 | 34 |
| Ex. 61 | 687 | 2435 | 10 | >20 | 0 | 32 |
| Ex. 62 | 663 | 2353 | 11 | >20 | 0 | 35 |
| Ex. 63 | 671 | 2374 | 12 | >20 | 0 | 32 |
| Ex. 64 | 644 | 2316 | 13 | >20 | 1 | 42 |
| Ex. 65 | 641 | 2308 | 12 | >20 | 0 | 44 |

TABLE 10

| | | Tensile Testing | | LCF Fracture | Number of AlN Precipitates | Fracture |
|---|---|---|---|---|---|---|
| | Hardness (HV) | Tensile Strength (MPa) | Elongation (%) | Life $\times 10^4$ (cycle) | with Thickness ≤1.0 μm and Aspect Ratio ≥10 | Toughness Value (MPa√m) |
| Ex. 66 | 664 | 2342 | 8 | >20 | 0 | 37 |
| Ex. 67 | 655 | 2323 | 13 | >20 | 0 | 26 |
| Ex. 68 | 658 | 2318 | 12 | >20 | 0 | 39 |
| Ex. 69 | 676 | 2398 | 8 | >20 | 0 | 36 |
| Ex. 70 | 649 | 2310 | 13 | >20 | 1 | 37 |
| Ex. 71 | 660 | 2326 | 12 | >20 | 0 | 35 |
| Ex. 72 | 673 | 2389 | 10 | >20 | 0 | 29 |
| Ex. 73 | 653 | 2305 | 10 | >20 | 0 | 44 |
| Ex. 74 | 651 | 2334 | 11 | >20 | 0 | 45 |
| Ex. 75 | 659 | 2323 | 14 | >20 | 0 | 39 |
| Ex. 76 | 649 | 2311 | 10 | >20 | 0 | 40 |
| Ex. 77 | 658 | 2326 | 11 | >20 | 2 | 39 |
| Ex. 78 | 651 | 2312 | 10 | >20 | 0 | 42 |

TABLE 10-continued

| | Hardness (HV) | Tensile Testing: Tensile Strength (MPa) | Tensile Testing: Elongation (%) | LCF Fracture Life $\times 10^4$ (cycle) | Number of AlN Precipitates with Thickness ≤1.0 μm and Aspect Ratio ≥10 | Fracture Toughness Value (MPa√m) |
|---|---|---|---|---|---|---|
| Ex. 79 | 655 | 2315 | 10 | >20 | 0 | 46 |
| Ex. 80 | 670 | 2375 | 8 | >20 | 0 | 42 |
| Ex. 81 | 663 | 2339 | 11 | >20 | 0 | 44 |
| Ex. 82 | 659 | 2335 | 11 | >20 | 0 | 36 |

TABLE 11

| | Hardness (HV) | Tensile Testing: Tensile Strength (MPa) | Tensile Testing: Elongation (%) | LCF Fracture Life $\times 10^4$ (cycle) | Number of AlN Precipitates with Thickness ≤1.0 μm and Aspect Ratio ≥10 | Fracture Toughness Value (MPa√m) |
|---|---|---|---|---|---|---|
| Comp. Ex. 51 | 639 | 2236 | 15 | >20 | 0 | 45 |
| Comp. Ex. 52 | 686 | 2409 | 7 | >20 | 0 | 30 |
| Comp. Ex. 53 | 689 | 2421 | 7 | >20 | 0 | 29 |
| Comp. Ex. 54 | 643 | 2251 | 10 | 6 | 0 | 32 |
| Comp. Ex. 55 | 647 | 2269 | 8 | >20 | 0 | 22 |
| Comp. Ex. 56 | 634 | 2227 | 14 | 8 | 13 | 48 |
| Comp. Ex. 57 | 670 | 2358 | 7 | >20 | 0 | 29 |
| Comp. Ex. 58 | 650 | 2276 | 11 | >20 | 2 | 22 |
| Comp. Ex. 59 | 627 | 2205 | 14 | >20 | 0 | 42 |
| Comp. Ex. 60 | 687 | 2424 | 5 | >20 | 0 | 29 |
| Comp. Ex. 61 | 655 | 2290 | 15 | >20 | 0 | 45 |
| Comp. Ex. 62 | 681 | 2399 | 7 | >20 | 0 | 29 |
| Comp. Ex. 63 | 666 | 2348 | 11 | 3 | 0 | 38 |
| Comp. Ex. 64 | 639 | 2242 | 11 | 9 | 7 | 38 |
| Comp. Ex. 65 | 686 | 2418 | 6 | >20 | 0 | 28 |

TABLE 12

| | Hardness (HV) | Tensile Testing: Tensile Strength (MPa) | Tensile Testing: Elongation (%) | LCF Fracture Life $\times 10^4$ (cycle) | Number of AlN Precipitates with Thickness ≤1.0 μm and Aspect Ratio ≥10 | Fracture Toughness Value (MPa√m) |
|---|---|---|---|---|---|---|
| Comp. Ex. 66 | 633 | 2224 | 10 | >20 | 2 | 37 |
| Comp. Ex. 67 | 636 | 2238 | 9 | 7 | 23 | 35 |
| Comp. Ex. 68 | 671 | 2356 | 7 | >20 | 0 | 29 |
| Comp. Ex. 69 | 621 | 2173 | 9 | >20 | 0 | 40 |
| Comp. Ex. 70 | 663 | 2334 | 7 | >20 | 0 | 30 |
| Comp. Ex. 71 | 662 | 2336 | 6 | >20 | 0 | 30 |
| Comp. Ex. 72 | 668 | 2355 | 6 | 7 | 0 | 29 |
| Comp. Ex. 73 | 651 | 2282 | 8 | 7 | 11 | 45 |
| Comp. Ex. 20 | 701 | 2445 | 7 | 3 | 31 | 24 |
| Comp. Ex. 21 | 658 | 2288 | 12 | 11 | 9 | 29 |
| Comp. Ex. 22 | 602 | 2084 | 14 | 10 | 13 | 65 |

While embodiments of the present invention have been described above in detail, the present invention should not be construed as being limited to the above embodiments in any way, and it will be apparent that various changes and modifications can be made without departing from the spirit and scope of the invention.

The present application is based on Japanese patent application No. 2015-104465 filed on May 22, 2015 and Japanese patent application No. 2015-247124 filed on Dec. 18, 2015, and contents thereof are incorporated herein by reference.

INDUSTRIAL APPLICABILITY

Because the maraging steels according to the present invention have very high tensile strengths of 2,300 MPa or higher, it is possible to use them as members of which high strength is required, such as structural materials for spacecraft and aircraft, parts for continuously variable transmission of automobile engines, materials for high-pressure vessels, materials for tools, and molds.

More specifically, the maraging steels according to the present invention can be used for engine shafts of aircraft, motor cases of solid rockets, lifting apparatus of aircraft, engine valve springs, heavy-duty bolts, transmission shafts, high-pressure vessels for petrochemical industry, and so on.

What is claimed is:

1. A maraging steel consisting of:

as essential components, 0.10 mass %≤C≤0.35 mass %, 9.0 mass %≤Co≤20.0 mass %, 1.0 mass %≤(Mo+W/2)≤2.0 mass %, 1.0 mass %≤Cr≤2.6 mass %, 6.0 mass %≤Ni≤20.0 mass %, 0.50 mass %≤Al≤2.0 mass %, and 0.020 mass %<V+Nb≤0.60 mass %, and as optional components, Ti≤0.10 mass %, S≤0.0010 mass %, N≤0,0020 mass %, B≤0.0050 mass %, and Si≤1.0 mass %, with a balance being Fe and inevitable impurities, wherein a number of AlN inclusion having a minor axe of 1.0 μm or smaller and an aspect ratio of 10 or larger is 0 per 100 $mm^2$ when observed under Scanning Electron Microscope (SEM), and wherein a following relational expression is satisfied:

Parameter X≥13.2, wherein X=5.5[C]+11.6[Si]−1.4[Ni]−5[Cr]−1.2[Mo]+0.7[Co]+41.9[Al]−7[V]−98.4[Nb]+3.3[B], and each element symbol with braces represents a content (by mass %) of each element.

2. The maraging steel according to claim 1, wherein a content of V satisfies:

0.050 mass %≤V≤0.60 mass %.

3. The maraging steel according to claim 1, wherein a content of Nb satisfies:

0.050 mass %≤Nb≤0.60 mass %.

4. The maraging steel according to claim 1, having a tensile strength of at least 2,300 MPa at (23° C.).

5. The maraging steel according to claim 1, having an elongation of at least 8% at (23° C.).

6. The maraging steel according to claim 1, wherein a content of B satisfies:

0.0010 mass %≤B≤0.0050 mass %.

7. The maraging steel according to claim 1, wherein a content of Si satisfies:

0.10 mass %≤Si≤1.0 mass %.

8. The maraging steel according to claim 1, used as an engine shaft of an aircraft.

9. The maraging steel according to claim 1, wherein the essential components include Mo and W.

10. The maraging steel according to claim 9, wherein 1.0 mass %≤(Mo+W/2)≤1.6 mass %.

11. The maraging steel according to claim 1, wherein 1.0 mass %≤(Mo+W/2)≤1.6 mass %.

12. The maraging steel according to claim 1, wherein an amount of Ni is:

6.0 mass %≤Ni≤9.0 mass %.

13. A maraging steel consisting of:

as essential components, 0.10 mass %≤C≤0.35 mass %, 9.0 mass %≤Co≤20.0 mass %, 1.0 mass %≤(Mo+W/2)≤2.0 mass %, 1.0 mass %≤Cr≤2.6 mass %, 6.0 mass %≤Ni≤9.4 mass %, and 1.45 mass %≤Al≤2.0 mass %, and as optional components, Ti≤0.10 mass %, S≤0.0010 mass %, N≤0.0020 mass %, V+Nb≤0.020 mass %, B≤0.0050 mass %, and Si≤1.0 mass %, with a balance being Fe and inevitable impurities, wherein a number of AlN inclusion having a minor axe of 1.0 μm or smaller and an aspect ratio of 10 or larger is 2 or less per 100 $mm^2$ when observed under Scanning Electron Microscope (SEM).

14. The maraging steel according to claim 13, wherein a following relational expression is satisfied:

Parameter X≥45, wherein X=5.5[C]+11.6[Si]−1.4[Ni]−5[Cr]−1.2[Mo]+0.7[Co]+41.9[Al]−7[V]−98.4[Nb]+3.3[B], and each element symbol with braces represents a content (by mass %) of each element.

15. The maraging steel according to claim 13, having a tensile strength of at least 2,300 MPa at (23° C.).

16. The maraging steel according to claim 13, having an elongation of at least 8% at (23° C.).

17. The maraging steel according to claim 13, wherein a content of B satisfies:

0.0010 mass %≤B≤0.0050 mass %.

18. The maraging steel according to claim 13, wherein a content of Si satisfies:

0.10 mass %≤Si≤1.0 mass %.

19. The maraging steel according to claim 13, used as an engine shaft of an aircraft.

20. The maraging steel according to claim 13, wherein 1.0 mass %≤(Mo+W/2)≤1.6 mass %.

* * * * *